US005404618A

United States Patent [19]

Heiler et al.

[11] Patent Number: 5,404,618

[45] Date of Patent: Apr. 11, 1995

[54] VEHICLE DOOR HINGE WITH INTERLOCK

[75] Inventors: Cornelius T. Heiler, Detroit; Richard R. Loizzi, Sterling Heights, both of Mich.

[73] Assignee: Chrysler Corporation, Highland Park, Mich.

[21] Appl. No.: 173,232

[22] Filed: Dec. 27, 1993

[51] Int. Cl.[6] ..... E05D 7/04

[52] U.S. Cl. ..... 16/261; 14/388

[58] Field of Search ..... 16/260, 261, 262, 265, 16/266, 270, 388

[56] References Cited

U.S. PATENT DOCUMENTS

| | | | |
|---|---|---|---|
| 4,807,331 | 2/1989 | Calucci | 16/262 |
| 4,864,687 | 9/1989 | Calcaterra et al. | 16/237 |
| 5,029,934 | 7/1991 | Schrader et al. | 296/146 |
| 5,054,165 | 10/1991 | Marchione | 16/270 |
| 5,067,201 | 11/1991 | Marchione | 16/270 |
| 5,297,314 | 2/1994 | Bender et al. | 16/270 |

*Primary Examiner*—Mark Rosenbaum
*Assistant Examiner*—Kenneth J. Hansen
*Attorney, Agent, or Firm*—Christopher Taravella

[57] ABSTRACT

A three piece lift-off door hinge assembly for a vehicle door comprising a door-half hinge plate and a body-half hinge sub-assembly incorporating an interlocking arrangement. The door-half hinge plate provides a notched-out connector while the body-half hinge plate of the sub-assembly has an upstanding latching pin. Upon the vehicle receiving an impact load of predetermined force a door-half hinge plate notched-out connector is adeapted for interlocking engagement with the pin thereby resisting door displacement by transmitting impact forces to the surrounding body frame structure.

3 Claims, 5 Drawing Sheets

VEHICLE DOOR HINGE WITH INTERLOCK

BACKGROUND OF THE INVENTION

This invention relates generally to automobile door hinges and, more particularly, to a three-piece lift-off door hinge assembly and mounting arrangement incorporating an integral door-half hinge plate to body-half hinge plate interlocking arrangement upon the application of an exterior impact load on the body.

It is well-known in the automotive industry to form a three piece separable door hinge. An example of one such hinge is shown in U.S. Pat. No. 4,864,687 issued Sep. 12, 1989 to Calcaterra et al. entitled Three Piece Door Hinge which enables a vehicle door to be readily removed and rehung during an assembly line operation.

The U.S. Pat. No. 4,807,331 issued Feb. 28, 1989 to Calucci entitled Door Lift-Off Hinge discloses another three piece door hinge assembly which provides self-alignment reception of the pintle pin within a leaf hinge pintle hole of the door-half member.

The U.S. Pat. No. 5,054,165 issued Oct. 1991 to Marchione entitled Door On-Door Off Vehicle Hinge With Hold-Open Mechanism concerns still another three piece separable hinge which includes a noise-free hold-open mechanism that remains in its entirety with the vehicle body when the door is removed.

SUMMARY OF THE INVENTION

It is an object of the present invention to provide a vehicle door hinge assembly incorporating an interlocking arrangement so as to improve the impact resistance of the vehicle body.

It is another object of the present invention to provide a vehicle door three piece lift-off door hinge assembly incorporating an integral interlock arrangement.

It is a further object of the present invention to provide a vehicle door three piece lift-off door hinge assembly as set forth above wherein the door-half hinge plate has a notched-out connector adapted, upon the door being impacted, to move into engagement with a vertical latch pin on the body-half hinge plate thereby improving the side impact resistance of the vehicle door.

BRIEF DESCRIPTION OF THE DRAWINGS

These and other objects, features and advantages of the invention will appear from the following written description and the accompanying drawings in which.

DETAILED DESCRIPTION OF THE INVENTION

Figure 1:
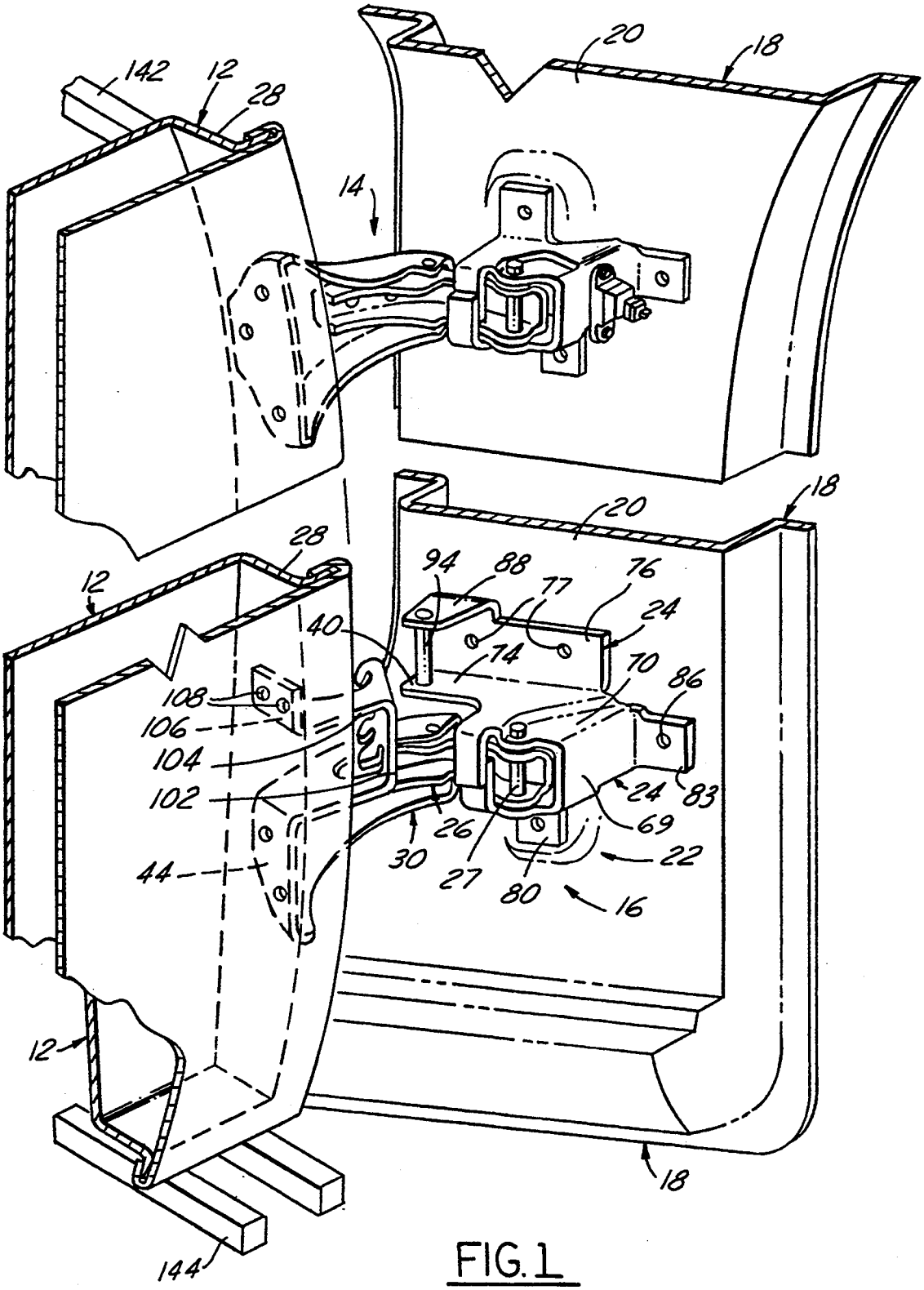
FIG. 1 is a fragmentary perspective view of showing a vehicle right hand door showing upper and lower hinge assemblies with the door swung to a partially open position.

Referring now to the drawings, and in particular to FIG. 1, there is shown a portion of a right hand passenger side door 12 wherein an upper readily separable three piece hinge assembly 14 and a lower readily separable three piece hinge assembly 16 are depicted supporting the door 12 in a partially open position on a vehicle body hinge post or pillar 18. As the upper hinge assembly 14 is not a part of the instant invention, only the lower hinge assembly 16 will be described in the present application.

Figure 8:
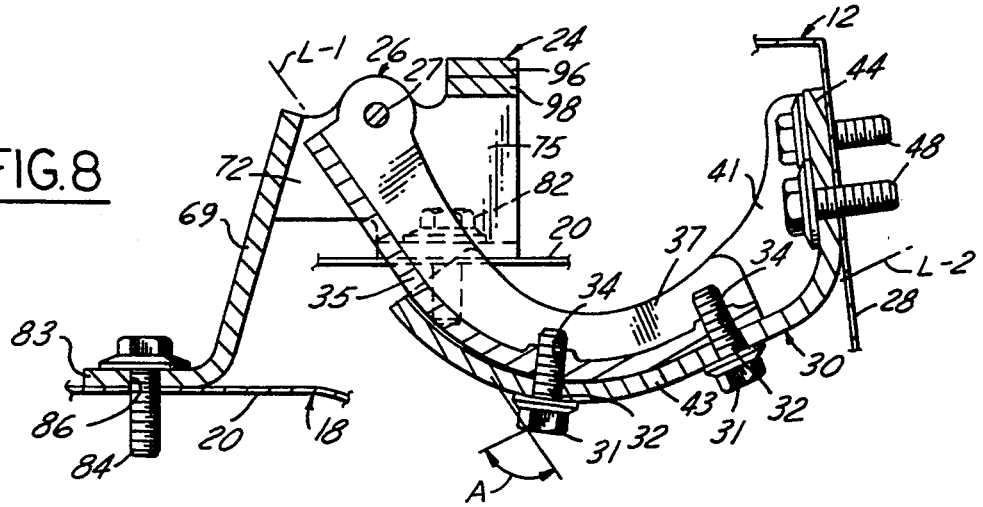
FIG. 8 is a horizontal sectional view taken on the line 8—8 of FIG. 4.

FIG. 1 shows a vehicle body upright door pillar panel 20 supporting a lower body-half hinge sub-assembly 22 comprising a body-half hinge plate 24 and a link plate 26 pivotally connected by a hinge pin 27. Door edge panel 28 is shown supporting a lower door-half hinge plate 30 of the hinge assembly 16. FIG. 8 shows the door-half mounting plate 30 releasably secured to the link plate 26 by bolts 31 extending through holes 32 in link plate base wall 33 aligned with associated holes 34 in vertically disposed bight wall 35 of the link plate 26. It will be noted in FIG. 8 that the bight wall 35 is arcuate-shaped when viewed in horizontal section. The link plate has upper 36 and lower 37 parallel horizontally disposed flanges extending from its bight wall 35.

Figure 9:
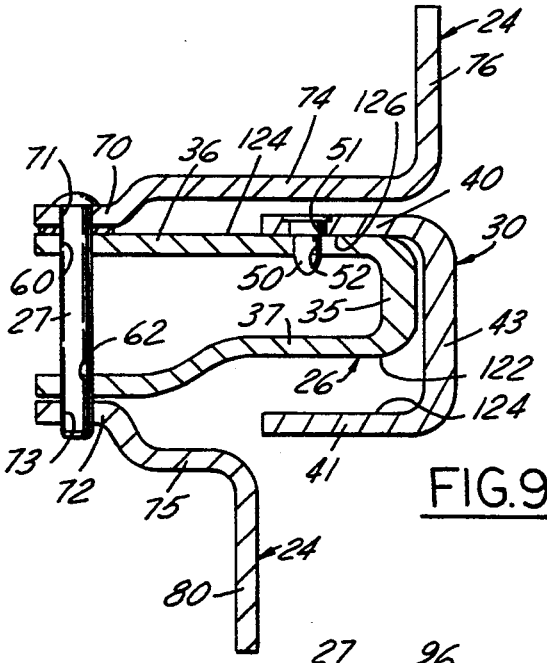
FIG. 9 is an enlarged fragmentary vertical sectional view taken on the line 9—9 of FIG. 6.

As seen in FIG. 9, the door-half hinge plate 30, having a generally channel or U-shape when viewed in vertical section, is formed with horizontally extending upper and lower flanges 40 and 41, respectively, joined by a vertically disposed bight wall 43. It will be noted in FIG. 8 that the bight wall 43 has an arcuate-shape in horizontal section which is complementary with the link plate arcuate-shaped bight wall 35 to permit juxtaposed nesting therebetween. The door-half hinge plate 30 has an end cap 44 adapted for flush attachment to the door frame edge panel 28 by bolts 48 (FIG. 5) extending through associated door holes (not shown).

Figure 5:
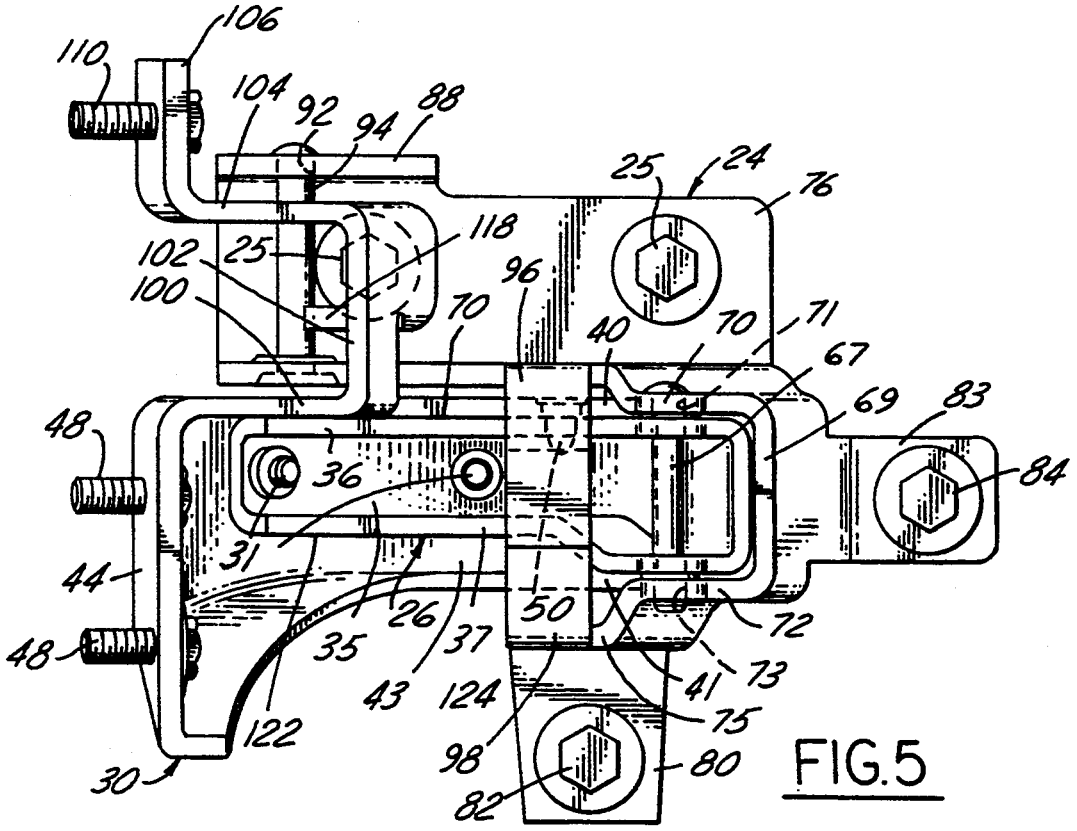
FIG. 5 is a fragmentary view of the lower hinge assembly taken on the line 5—5 of FIG. 3.
Figure 7:
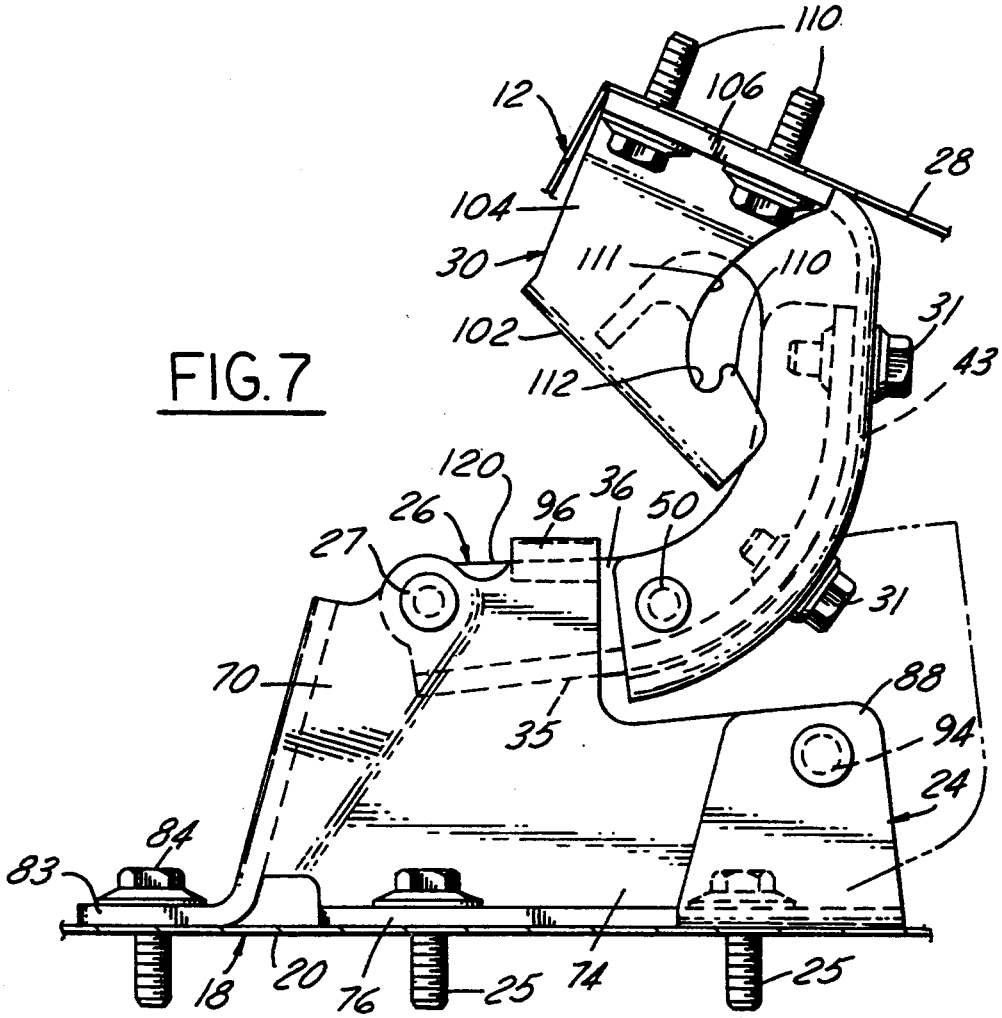
FIG. 7 is a fragmentary horizontal view similar to FIG. 6 showing the lower hinge in its door open position.

As best seen in FIG. 7, the link plate has a generally channel or U-shape when viewed in vertical section defining a vertically disposed bight wall 35. The link plate bight wall has a central arcuate shaped portion, when viewed in plan, terminating at each of its free ends in a pair of linear end sections. FIG. 8 shows a pair of intersecting construction lines "L-1" and "L-2", each common to an outer planar surface of an associated link plate bight wall end section, define an obtuse central angle "A" of about 110 degrees. Further, the door mounting plate bight wall 43 is shown with its free end terminating in an arcuate shaped portion, when viewed in horizontal section, formed complementary to the link plate bite wall central curved portion for nested flush reception on the inner surface of the bight wall 43. As seen in FIG. 5, when assembled in the above described nested manner the link plate 26 has a horizontal exterior surface of its upper flange 36 in mating flush contact with horizontal interior surface of door-half hinge plate upper flange 40.

Figure 2:
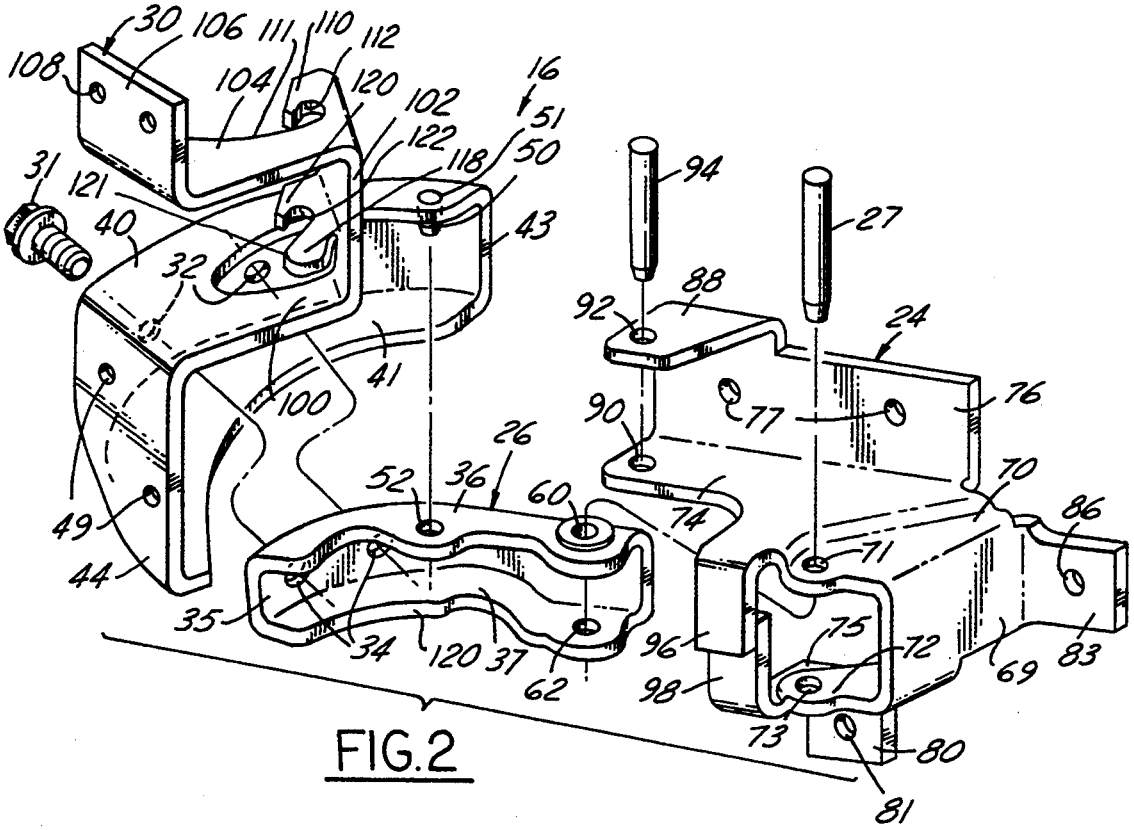
FIG. 2 is an exploded perspective view of the lower hinge assembly of FIG. 1.
Figure 3:
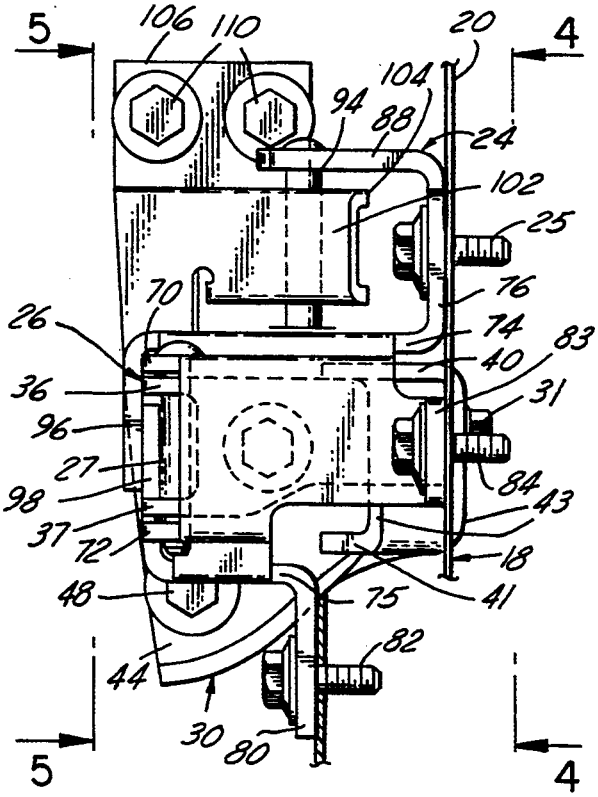
FIG. 3 is a fragmentary side view showing the lower hinge assembly oriented relative to the vehicle door.
Figure 4:
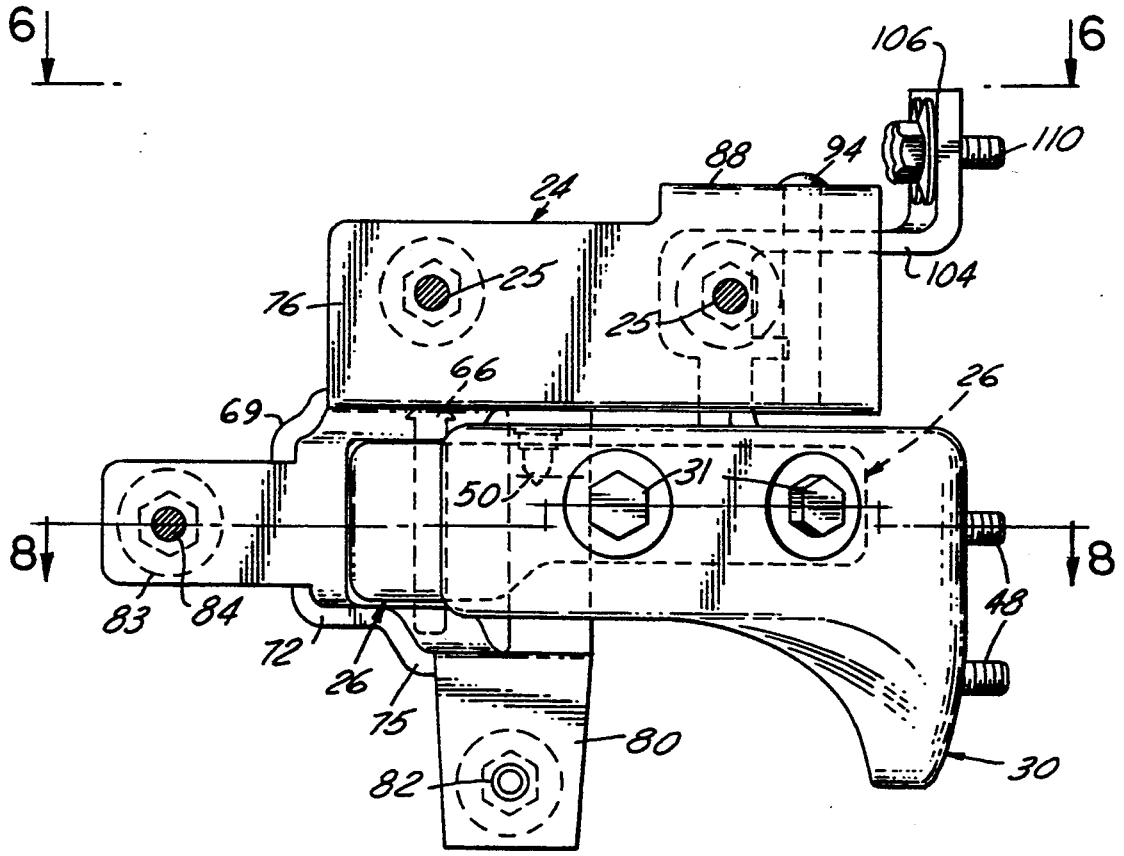
FIG. 4 is a fragmentary view of the lower hinge assembly taken on the line 4—4 of FIG. 3.

FIG. 9 shows the door-half hinge plate upper flange 40 having a cylindrical coupling dowel 50 staked in hole 51 with the dowel extending vertically downwardly therefrom with its lower end rounded in a bullet-like manner. An intermediate portion of the link plate upper flange 36 is provided with a coupling dowel hole 52 sized for sung reception of the door plate coupling dowel 50 without radial play upon the flush contact of the door plate upper flange 40 interior surface with an exterior surface of the link plate upper flange 36. With reference to FIG. 2, the link plate upper flange 36 has its one end provided with a hinge pin hole 60 vertically aligned with hole 62 in its lower flange 37 for the reception of the hinge pin 27.

The body-half hinge plate 24 is generally U-shaped having an upstanding bight wall 69 joining an upper horizontal flange 70, provided with a hinge pin hole 71, and a lower horizontal flange 72 provided with aligned hinge pin hole 73. FIG. 5 shows the upper 71 and lower 73 holes vertically aligned for the reception of hinge pin 27 upon the one hinge pin end of the link plate 26 being received in a close fit manner between the upper 70 and lower 72 flanges of the body-half mounting plate 24.

The body-half mounting plate has an upper offset flange portion 74 upwardly offset out of the plane of its upper integral flange 70 while its lower flange 72 (FIG. 5) has an downwardly offset portion 75 formed out of the plane of its associated lower flange 72. The body-half upper flange 70 has an upright flange 76 provided with bolt holes 77 for receiving bolts 25 for attachment to the body panel 20. The lower flange 75 has a downstanding mounting tongue 80 provided with a hole 81 for attachment to the body panel 20 by bolt 82.

Figure 6:
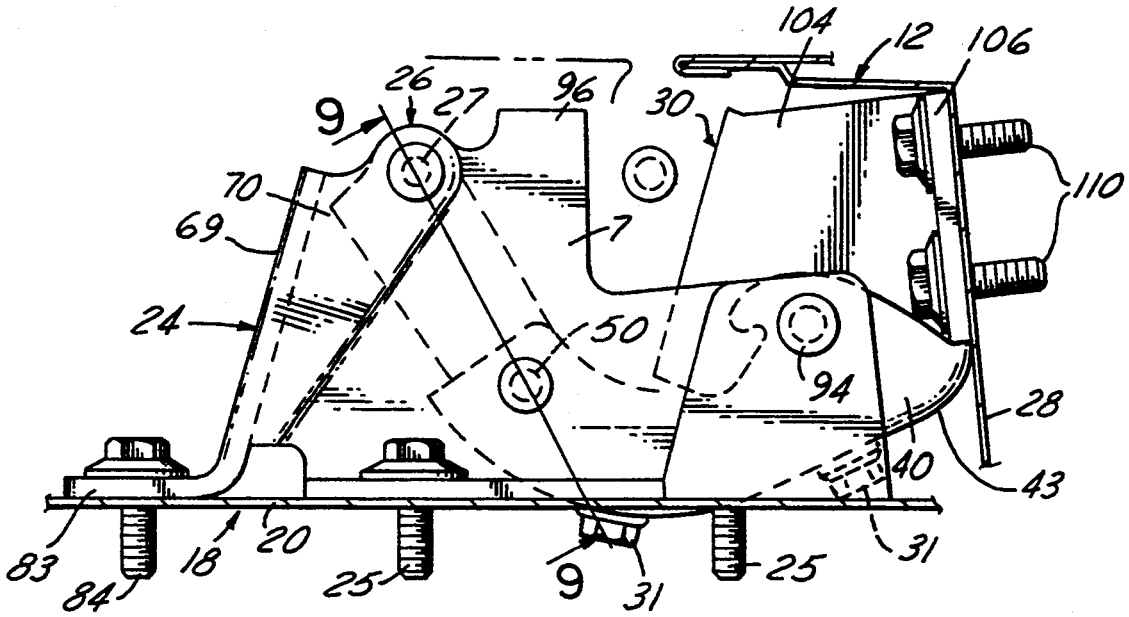
FIG. 6 is a fragmentary horizontal view taken substantially on the line 6—6 of FIG. 4 showing the lower hinge in its door closed position.

As seen in FIGS. 2 and 6, the body-half hinge plate 24 vertically disposed bight portion is 44 is formed with an angled leaf 83 adapted for flush contact with the door pillar body panel 20 by a bolt 84 received in hole 86 (FIG. 2). It will be noted that the upright flange 74 has its inboard end provided with a horizontally extending latch flange 88 bent therefrom overlying in vertically spaced relation the body-half hinge plate upper offset flange 74. The upper offset flange 74 has a mounting hole 90 vertically aligned with an upper latch flange mounting hole 92. First engaging means in the form of a vertically disposed male latch connector or pin 94 is sized such that its free ends are adapted to be secured, as by welding, in respective upper and lower mounting holes 90 and 92. Upper and lower vertically disposed straps 96 and 98 are bent out of upper and lower offset flanges 74 and 75, respectively, of the body-half hinge plate. The straps 96 and 98 have opposed inner and outer surfaces thereof in flush contact connected and are secured, as by welding, increasing the rigidity of the body-half hinge plate 24.

As best seen in FIG. 2, the door-half hinge plate upper flange 40 has its one mounting end provided with a flange projection 100 formed with a double-L sectioned integral bracket defined by a vertical riser 102, a horizontal step flange 104, and a vertically disposed upper door mounting upright 106. The upright 106, disposed in a plane common with the door-half hinge plate end cap 44, is adapted for flatwise mounting contact with the door edge panel 46. FIG. 1 shows the upright 106 having a pair of holes 108 for the reception of bolts 110 for attachment to door panel 46.

Figure 10:
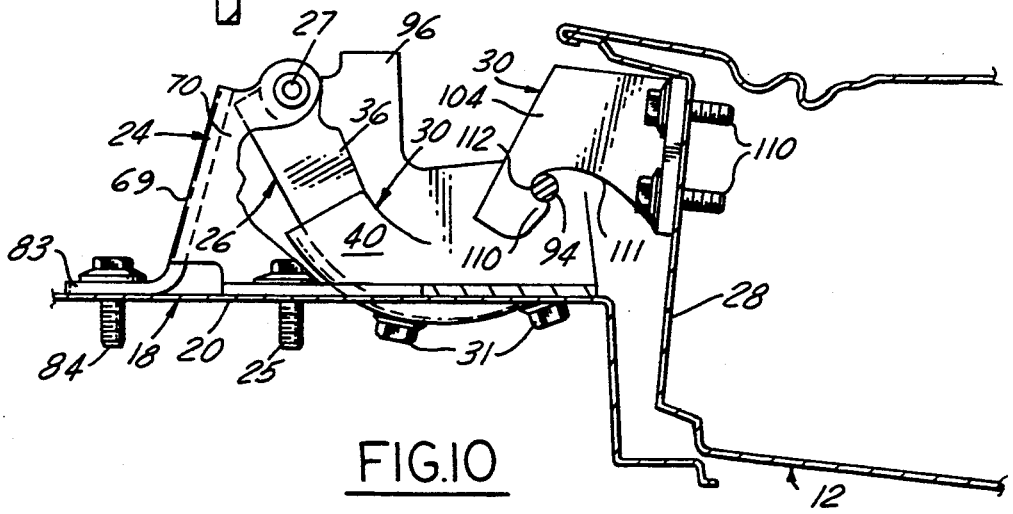
FIG. 10 is a fragmentary horizontal sectional view, partly in elevation, of the lower hinge showing the vehicle door and adjacent body after undergoing an impact.

With reference to FIG. 7, it will be seen that the step flange 104 is provided with second engaging means in the form of a female notched-tooth connector 110 having an arcuate-shaped lead-in flank 111 terminating in a half-round flute 112. It will be seen in FIG. 10 that upon the vehicle door 12 undergoing a predetermined exterior impact load thereon the first male latch pin connector 94 is adapted to contact the lead-in flank 111 for guided movement into engagement by the conforming half-round flute 112. The inter-engaging of the pin 94 and the notch-tooth connector 110 operates to dissipate a portion of the impact load thereby minimizing deformation of the door 12 and the surrounding body structure.

FIG. 2 shows the riser 102 formed with a lower flange 118 provided with a second lower notch-tooth female connector 120 identical to the above described connector 110. The second lower connector matching arcuate lead-in flank 121 and half-round flute 122 are adapted to engage the pin 94 in unison with the upper notch-tooth connector 110. It will be understood, however, that in a situation where the pin 94 engages either the upper 110 or the lower 120 notch-tooth connector applicants' hinge interlocking arrangement will function to minimize deformation of the door.

Means are provided for hanging the door-half hinge plate 30, secured to the door edge panel 12, from the link plate 26 by means of the dowel 50. As seen in FIGS. 1 and 7, the body-half sub-assembly 22 fixed on the vehicle body panel 20 and the link plate 26 pivoted to its maximum full open position of FIG. 7 wherein link plate lower flange 37 outer free edge contacts an inner surface of the lower strap 98.

Figure 9A:
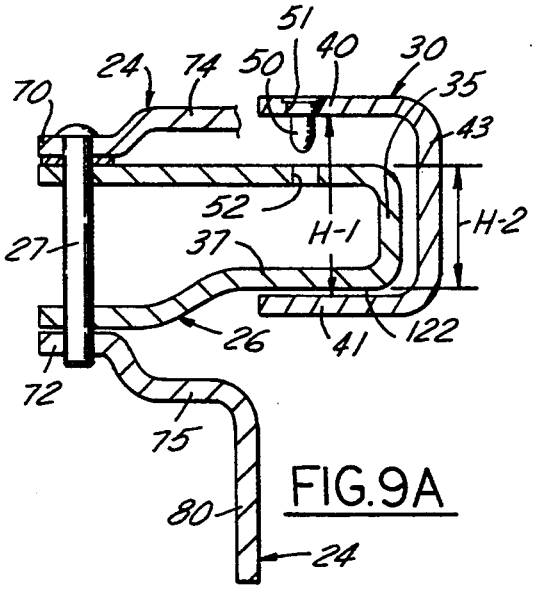
FIG. 9A is a view similar to FIG. 9 showing an intermediate step in the door lift-off hinge arrangement.

With reference to FIG. 9A, the door 12, together with the door-half plate 30, is moved by automated door conveying means such as a robot, indicated schematically by robot arms 142 and 144 in FIG. 1. The door is moved laterally until the inner surface of its bight wall 43 nests in a conforming juxtaposed manner with an outer surface of the link plate bight 35 and an exterior undersurface 122 of the link plate is juxtaposed with an upper internal surface 124 of the door-half plate lower flange 41. It will be noted in FIG. 9A that the internal height H-1 of the door-half plate bight wall 43 is a predetermined dimension greater than the external height H-2 of the link plate 26. This enables the door 12, upon the removal of the pair of bolts 31, to be raised vertically by the robot arms until its dowel 50 clears its link plate coupling bore 52. Thereafter, the door 12 may be removed laterally to a work station for assembly line trim operations and thereafter readily re-mounted on the body by reversing the above procedure.

While a preferred embodiment of the invention has been illustrated and described, this is only for the purposes of illustration. It is, therefore, to be understood that within the scope of the appended claims, the invention may be practiced otherwise than as specifically described.

What is claimed is:

1. A three piece hinge assembly for mounting a door for swinging between open and closed positions on the body of a vehicle, said hinge assembly comprising a body-half sub-assembly having a body-half plate and a link plate, a door-half hinge plate, means for securing said body-half plate and said door-half plate to the body and the door, respectively, pivot means for pivotally connecting said link plate to said body-half plate, means for detachably connecting said link plate to said door-half plate, whereby said door-half plate may be released from and re-attached to said link plate to permit the door to be quickly removed from and re-installed on the vehicle body, the combination comprising:

a portion of said door-half hinge plate formed with first engaging means and a portion of said body-half hinge plate formed with second engaging means, said first engaging means adapted, during normal door swinging travel, to clear said second engaging means so as not to interlock therewith;

whereby in response to the application of a predetermined exterior impact load on the vehicle body causing the door to deform slightly relative to the body such that said door-half hinge plate first engaging means inter-engages with said body-half hinge plate second engaging means so as to dissipate a portion of the impact load thereby minimizing the deformation of the door;

said door-half hinge plate first engaging means is in the form of a notched-out connector and said body-half hinge plate second engaging means in the form of a vertically disposed pin member; and said notched-out connector comprising a concave curved lead-in flank portion terminating in a concave flute catch portion whereby with said hinge assembly in its door closed mode said latch pin being positioned adjacent said lead-in flank portion, such that said lead-in flank portion is adapted to engage said latch pin for guided interlocked capture by said catch portion upon the vehicle body being impacted by said predetermined load.

2. The hinge assembly as set forth in claim 1 wherein said link plate being U-shaped in vertical section having a pair of upper and lower flanges extending from a bight wall, vertically aligned holes in one end of said link plate flanges for reception of the hinge pin;

said body-half hinge plate being generally U-shaped in vertical section having a pair of upper and lower horizontal flanges extending from a bight wall, vertically aligned holes said body-half flanges for reception of the hinge pin;

said link plate having one end thereof sized for reception between said body-half hinge plate pair of flanges such that the hinge pin extends through said body-half hinge plate flange holes and said link plate flange holes;

said body-half hinge plate upper flange having an extension terminating in a vertically disposed mounting panel adapted for attachment to a body door pillar, said mounting panel terminating at its inboard end in a horizontal tongue spaced above said upper flange extension, and said latch pin having a lower end fixed to said flange extension and an upper end fixed to said tongue portion.

3. The hinge assembly as set forth in claim 1 wherein said door-half hinge plate being generally U-shaped in vertical section having a pair of upper and lower flanges extending from a bight wall, said door-half hinge plate upper flange provided with a projection defining a double-L shaped bracket comprising a vertical riser, a horizontal step, and an upright door mount;

said bracket step having an inboard edge formed with a concave arcuate lead-in flank portion terminating in a radiused flute catch portion defining said notched-out connector, and whereby with the door closed said bracket lead-in curved portion positioned in a predetermined manner relative to the body-half hinge plate latch pin.

* * * * *